US006172455B1

(12) United States Patent
Bancal et al.

(10) Patent No.: US 6,172,455 B1
(45) Date of Patent: Jan. 9, 2001

(54) FLAT DISPLAY SCREEN INCLUDING A CATHODE HAVING ELECTRON EMISSION MICROTIPS ASSOCIATED WITH A GRID FOR EXTRACTING ELECTRONS FROM THE MICROTIPS

(75) Inventors: Bernard Bancal, Luynes; Jean-François Peyre, Rousset; Philippe Peyron, Palette-le Tholonet, all of (FR)

(73) Assignee: Pixtech S.A., Rousset (FR)

( * ) Notice: Under 35 U.S.C. 154(b), the term of this patent shall be extended for 0 days.

(21) Appl. No.: 09/162,543

(22) Filed: Sep. 29, 1998

(30) Foreign Application Priority Data

Sep. 30, 1997 (FR) ..... 97/12392

(51) Int. Cl.[7] ..... H01J 1/62; H01J 63/04

(52) U.S. Cl. ..... 313/495; 313/309; 313/336; 313/351; 315/169.3; 345/74; 345/75

(58) Field of Search ..... 313/495, 497, 313/336, 351, 297, 296, 293, 301, 309, 496, 306, 308, 310, 442; 315/169.1, 169.2, 169.3; 345/74, 75

(56) References Cited

U.S. PATENT DOCUMENTS 3,931,633 * 1/1976 Shannon et al. ..... 357/30
5,194,780 * 3/1993 Meyer ..... 313/309
5,541,478 * 7/1996 Troxell et al. ..... 313/497
5,557,159 * 9/1996 Taylor et al. ..... 313/336
5,572,041 * 11/1996 Betsui et al. ..... 313/309
5,592,056 * 1/1997 Peyre et al. ..... 315/169.1
5,631,518 * 5/1997 Barker ..... 313/309
5,703,611 * 12/1997 Kishino et al. ..... 313/497
5,952,987 * 9/1999 Browning et al. ..... 345/74
5,994,832 * 11/1999 Yura et al. ..... 313/495
6,020,595 * 2/2000 Itoh et al. ..... 313/309
6,020,683 * 2/2000 Cathey, Jr. et al. ..... 313/497
6,020,864 * 2/2000 Bancal ..... 345/74

* cited by examiner

*Primary Examiner*—Michael H. Day
*Assistant Examiner*—Mariceli Santiago
(74) *Attorney, Agent, or Firm*—Arthur L. Plevy; Buchanan Ingersoll PC

(57) ABSTRACT

The present invention relates to a flat display screen, comprising a cathode with electron emission microtips associated with a grid for extracting electrons from the microtips, the cathode/grid comprising conductive grid or cathode lines adapted to being sequentially addressed, and cathode or grid columns perpendicular to the lines and adapted to being addressed individually and simultaneously during the addressing of a line, and the screen comprising a return electrode adapted to being biased to a return potential corresponding to a no electron emission potential, each grid or cathode line being connected, via at least one resistive element, to the return electrode.

10 Claims, 5 Drawing Sheets

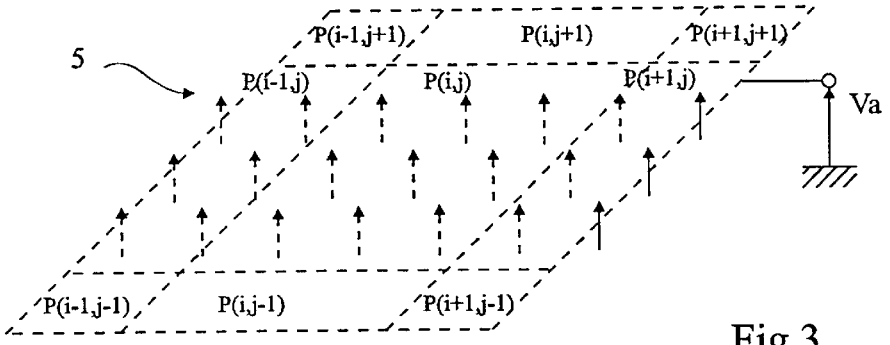
Fig 3
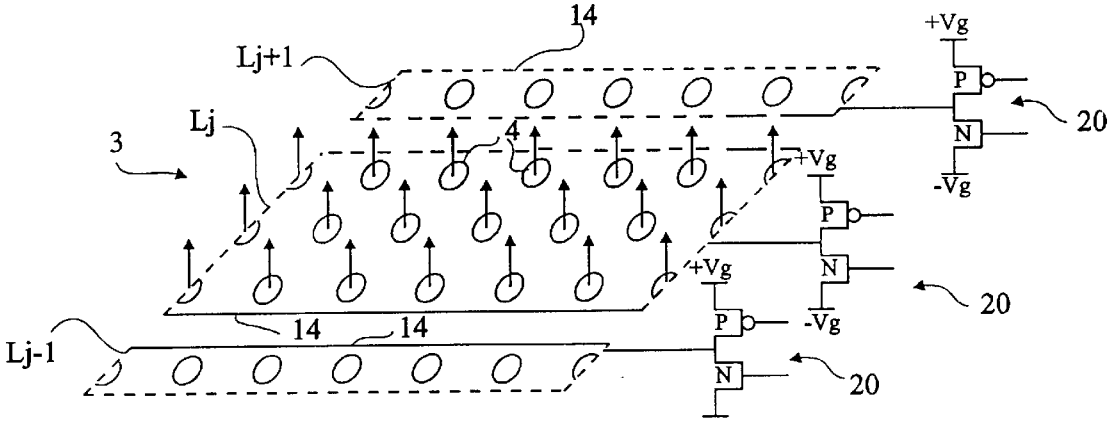
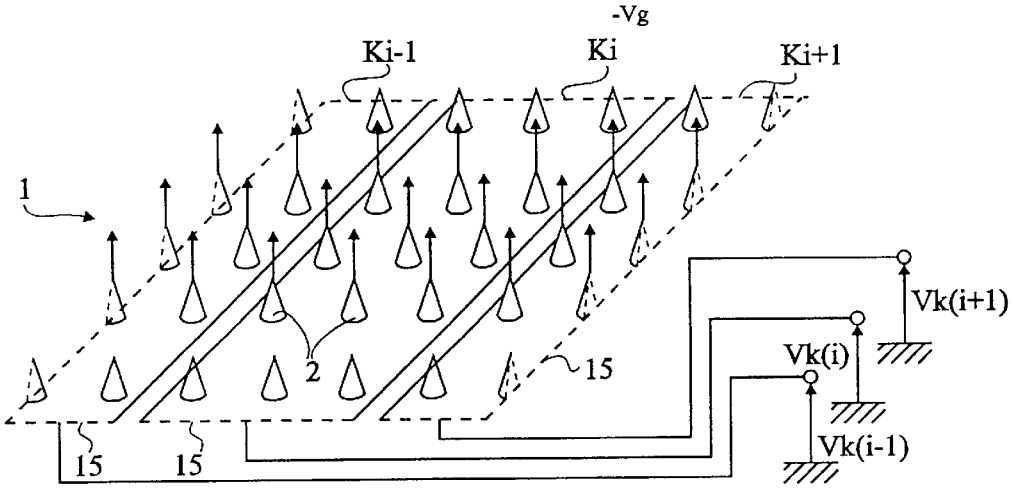

FLAT DISPLAY SCREEN INCLUDING A CATHODE HAVING ELECTRON EMISSION MICROTIPS ASSOCIATED WITH A GRID FOR EXTRACTING ELECTRONS FROM THE MICROTIPS

BACKGROUND OF THE INVENTION

1. Field of the Invention

The present invention relates to the field of flat microtip display screens.

2. Discussion of the Related Art

FIG. 1 schematically shows the structure of a flat microtip screen of the type to which the present invention relates.

Such a microtip screen is essentially formed of a cathode 1 with microtips 2 and of a grid 3 provided with holes 4 corresponding to the locations of microtips 2. Cathode 1 is placed opposite to a cathodoluminescent anode 5, a glass substrate 6 of which generally forms the screen surface.

The cathode conductors are arranged in columns on a glass substrate 10. Microtips 2 are made on a resistive layer 11 deposited, for example, on the cathode conductors and are conventionally arranged within meshes defined by the cathode conductors. FIG. 1 partially shows the inside of a mesh, without showing the cathode conductors. Cathode 1 is associated with grid 3 which is organized in lines. The intersection of a line of grid 3 and of a column of cathode 1 defines a pixel.

This device uses the electric field created between cathode 1 and grid 3 to extract electrons from microtips 2 towards phosphor elements 7 of anode 5. In the case of a color screen such as shown in FIG. 1, anode 5 is provided with alternate strips of phosphor elements 7, each corresponding to a color (Red, Green, Blue). The strips are separated from one another by an insulator 8. Phosphor elements 7 are deposited on electrodes 9, formed of corresponding strips of a transparent conductive layer such as indium and tin oxide (ITO). The sets of red, green, blue strips are alternately biased with respect to cathode 1, so that the electrons extracted from the microtips 2 of a pixel of the cathode/grid are alternately directed to the phosphor elements 7 facing each of the colors. In the case of a monochrome screen (not shown), the anode is formed of a plane of phosphor elements of same color or of two sets of alternate strips of phosphor elements of same color.

The present invention more specifically relates to the cathode/grid of such a screen.

FIGS. 2A to 2D illustrate an example of conventional structure of a microtip screen cathode/grid, FIGS. 2B and 2D respectively being enlargements of portions of FIGS. 2A to 2C. Several microtips 2, for example, sixteen, are arranged in each mesh 12 defined by the cathode conductors 13 (FIG. 2B). The intersection of a line 14 of grid 3 and of a column 15 of cathode 1 here corresponds, for example, to sixty-four meshes 12 of a cathode pixel (FIG. 2A).

Cathode 1 is generally formed of layers successively deposited on glass substrate 10. FIGS. 2C and 2D partially show a cross-sectional view along line A–A' of FIG. 2B. A conductive layer is deposited on substrate 10. This layer is etched according to a column pattern 15, each column comprising meshes 12 surrounded with cathode conductors 13. A resistive layer 11 is then deposited on these cathode conductors 13. This resistive layer has the purpose of protecting each microtip 2 against an excess current upon starting of a microtip 2. Such a resistive layer 11 homogenizes the electron emission of the microtips 2 of a pixel of cathode 1 and thus increases its lifetime. The resistive layer is deposited, either on the conductive layer constitutive of the cathode conductors, or under this conductive layer, as described in document EP-A-0696045. An isolating layer 16 is deposited on resistive layer 11 to isolate cathode conductors 13 from grid 3 (FIG. 2D), formed in a conductive layer. Holes 4 and wells 17 are respectively made in layers 3 and 16 to receive microtips 2.

To avoid current leaks from one column of the cathode to another (which cause an excessive heating of the cathode likely to result in a screen breakage in operation), resistive layer 11 must, most often, be etched in columns corresponding to the columns (15, FIG. 2A) of the cathode. Such an etching requires a mask distinct from that used to make the cathode conductors, since the resistive layer is not meshed.

FIG. 3 schematically illustrates, in perspective view, an example of conventional addressing of a microtip screen.

For clarity, the meshing of columns K of cathode 1 has not been shown. Similarly, cathode 1 has been shown spaced apart from grid 3 whereas, in practice, the tops of microtips 2 reach holes 4 made in grid 3. Further, only nine microtips per pixel have been shown. In practice, they are several thousands per screen pixel. On the side of anode 5, the surfaces of pixels P have been shown in mixed lines.

The display of an image is performed during an image time (for example, 20 ms for a 50-hertz frequency) by properly biasing anode 5, cathode 1, and grid 3 by means of an electronic control circuit (partially shown for the grid control).

Concerning a monochrome screen anode 5, the plane of phosphor elements of the anode is permanently biased to a potential Va enabling to attract the electrons emitted by microtips 2. To choose this potential, the distance which separates the cathode/grid from the anode is especially taken into account, and this potential is, for example, on the order of 400 volts. For a color screen, the strips of phosphor elements of the anode are sequentially biased by sets of strips of a same color for a frame time corresponding to one third of the image time minus the times required for the switchings.

The display is performed line by line, by sequentially biasing the lines L of grid 3 for a "line time" during which each column K of cathode 1 is brought to a potential Vk which depends on the brightness of the pixel to be displayed along the current line (for example, Lj). The biasing of columns K of cathode 1 changes for each new line. A "line time" (for example, 40 $\mu$s) corresponds to the duration of a frame divided by the number of lines L of grid 3. Current line Lj is brought to a potential +Vg (for example, 40 volts) for this line time whereas the other lines Lj−1, Lj+1 are at a potential .Vg (for example, −40 volts) during the line time. Columns K of the cathode are brought to respective potentials Vk(i−1), Vk(i), Vk(i+1) included between a maximum emission potential and a no emission potential (for example, respectively 0 and 0.40 volts) representing, for each line, the brightness of the pixel defined by the intersection of column K and of line L. The choice of the biasing potential values is linked to the characteristics of the phosphor elements and of the microtips. Conventionally, below a potential difference on the order of 40 volts between cathode 1 and grid 3, there is no electron emission, and the maximum emission used corresponds to a potential difference of approximately 80 volts.

The sequentially addressed lines of grid 3 are individually controlled by an amplifier 20, generally essentially formed of two P and N MOS transistors mounted in series between two supply lines at potentials +Vg and .Vg. The midpoint of the series association of the P and N transistors is connected to the grid line associated with amplifier 20 and the P-channel and N-channel MOS transistors, respectively, receive on their gates control signals (not shown) adapted to successively biasing the lines to high potential +Vg, all unaddressed lines being brought to low potential .Vg. It is indeed required to bring the unaddressed lines back to potential .Vg, to avoid that a previously addressed line be at a sufficient potential enabling to extract electrons.

A disadvantage of conventional screens is that the amplifiers 20 have to be made in CMOS technology, which increases the cost of the control circuit. Further, since one amplifier per line is required, the number of amplifiers made in CMOS technology is far from being negligible with respect to the bulk and to the global cost of the control circuit.

It has already been provided to simplify the structure of the control amplifiers of the grid lines by leaving the unaddressed lines at a floating potential. Such a solution requires the use, on the cathode side, of an additional column of microtips forming a so-called electrode of reset of the unaddressed grid lines. Such a solution is described in French patent application No. 2687841. In this patent application, the grid lines are prolonged on one side of the screen to an additional cathode column. This cathode column is addressed independently from the other columns and is brought, between each line time, to a sufficiently low potential with respect to the nominal grid biasing potential to enable an electron emission by this reset column. The electrons then emitted by the microtips of this column are meant to fall back on the grid line just addressed to lower its potential.

Although such a solution enables to use a single transistor per grid line addressing amplifier, it has several disadvantages.

First, this solution requires the addition of an additional cathode column, and this column must, in practice, be located outside the active screen area, that is, the display area, which increases the screen bulk. Further, the fact that the additional electrode is placed at one end of the grid line results in the potential lowering of the line just addressed being all the longest as the grid lines are long. Therefore, this document provides to add a second reset column at the other end of the screen. This further increases the bulk of the screen surface without being an optimal solution. Further, to provide reset columns distributed between the cathode display columns is an unadapted solution. First, the cathode display columns have to be spaced apart, which is prejudicial to the screen resolution, the reset column surfaces having to be large to emit a sufficient amount of electrons to quickly lower the grid line potential. Moreover, this complexifies the implementation of the anode, which must then be biased to a potential lower than the grid line addressing potential, to enable to repel the electrons emitted by the reset column towards the grid. Further, the electron emission by the additional column(s), between each line time, appears to be prejudicial to the screen lifetime.

SUMMARY OF THE INVENTION

According to a first aspect, the present invention aims at providing a novel solution for simplifying the structure of amplifiers of sequential addressing of the scan lines of a flat microtip display screen.

The present invention aims, in particular, at providing a solution which requires no electron emission.

The present invention also aims at providing a solution which does not cause an increase of the screen surface, or a decrease of the resolution of a conventional screen.

The present invention also aims at providing a solution which requires no modification of the anode of a conventional screen.

According to a second aspect, the present invention also aims at accompanying the structure simplification of sequential line addressing amplifiers by a simplification of the method of implementation of the screen cathode.

To achieve these objects, the present invention provides a flat display screen, comprising a cathode with electron emission microtips associated with a grid for extracting electrons from the microtips, the cathode/grid comprising conductive grid or cathode lines adapted to being sequentially addressed, and cathode or, respectively, grid columns perpendicular to the lines and adapted to being addressed individually and simultaneously during the addressing of a line, the screen further comprising a return electrode adapted to being biased to a return potential corresponding to a no electron emission potential, each grid or cathode line being connected, via at least one resistive element, to the return electrode.

According to an embodiment of the present invention, the return electrode is formed of conductive lines, interposed between two neighboring lines of the grid or cathode, and interconnected to the return potential.

According to an embodiment of the present invention, the lines of the grid or cathode and the lines of the return electrode are implemented in a same etched conductive layer, each line of the return electrode being spaced apart from the two neighboring lines of the grid or cathode.

According to an embodiment of the present invention, a resistive layer is present over or under the conductive layer.

According to an embodiment of the present invention, each line of the grid is associated with a control amplifier, an output stage of which exclusively comprises a P-channel MOS transistor, interposed between a high addressing potential and the line, the return electrode being biased to a low potential.

According to an embodiment of the present invention, each conductive line of the return electrode is sized to form a resistive element between a neighboring grid line and the return potential.

According to an embodiment of the present invention, each line of the cathode is addressable by a control amplifier, an output stage of which exclusively comprises an N-channel MOS transistor, interposed between a low addressing potential and the line, the return electrode being biased to a high potential.

According to an embodiment of the present invention, the microtips are deposited on the resistive layer forming a resistive element between each cathode line and the return electrode.

According to an embodiment of the present invention, the return electrode is formed of conductors, interposed between the columns of the grid and separated from the conductive layer in which the lines of the cathode are formed, by the resistive layer.

According to an embodiment of the present invention, the return electrode is biased between the periods of addressing of two successive lines, and is left floating during the line addressing.

The foregoing objects, features and advantages of the present invention will be discussed in detail in the following non-limiting description of specific embodiments, in conjunction with the accompanying drawings.

BRIEF DESCRIPTION OF THE DRAWINGS

FIG. 3 schematically illustrates, in a perspective view, an example of conventional addressing of a microtip screen;

DETAILED DESCRIPTION

Figure 1:
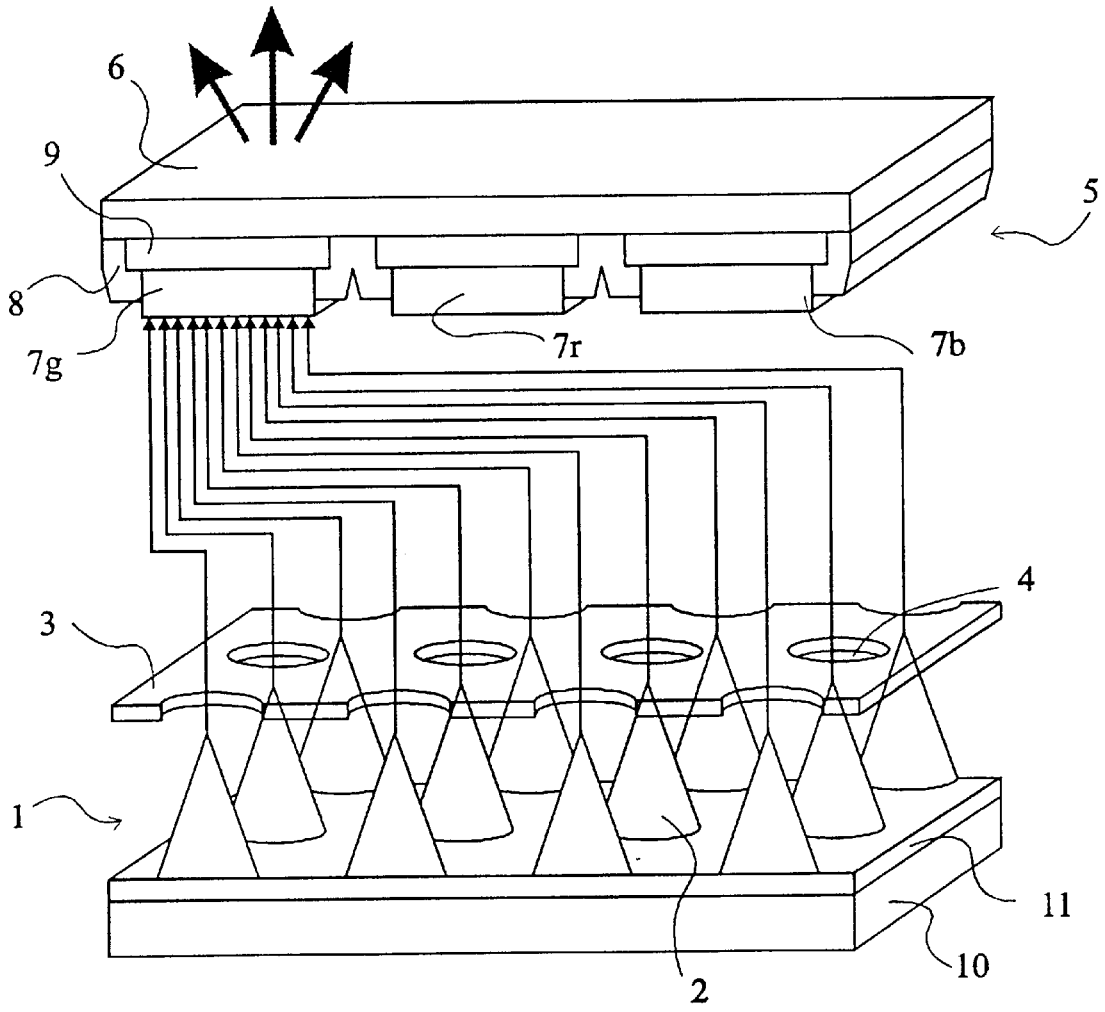
FIG. 1 schematically illustrates a structure of a flat microtip screen of a type to which the present invention relates.

The same elements have been referred to with the same references in the different drawings. For clarity, the representations of the drawings are not to scale and only those elements necessary to the understanding of the present invention have been shown in the drawings and will be described hereafter.

A characteristic of the present invention is to bring each scan line just addressed back to a potential corresponding to a no electron emission potential, by means of an ohmic contact of this scan line with a return electrode biased to this potential.

As previously, a screen according to the present invention is formed of a microtip cathode associated with a grid, the cathode/grid being placed opposite to a cathodoluminescent anode provided with phosphor elements. The display of an image is performed by sequentially addressing electrodes in lines of the grid or cathode, electrodes in perpendicular columns of the cathode or grid being simultaneously and individually addressed during the addressing of each line to set the respective brightnesses of the pixels defined by the intersections of the columns with the current line. In the case of a color screen, the brightness of the color component of the corresponding pixel is set, the anode being, for example, provided with three sets of alternate strips of phosphor elements of different colors. In a monochrome screen, the level of grey of the corresponding pixel is set, the anode being formed of a plane of phosphor elements of same color or of two sets of alternate strips of phosphor elements of same color.

Figure 4:
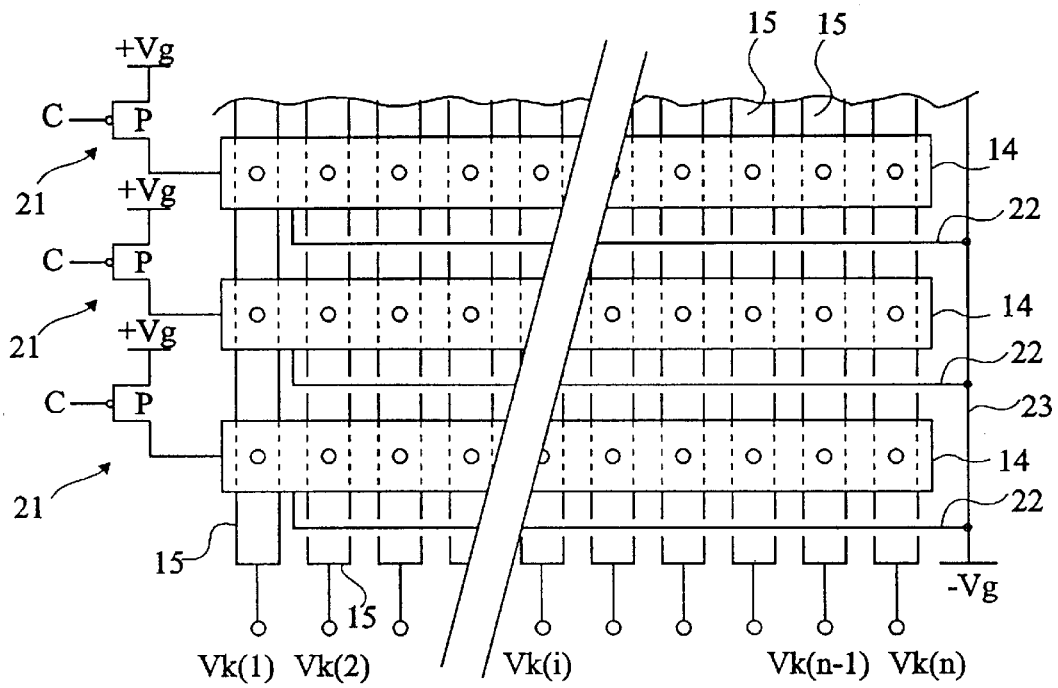
FIG. 4 shows, in top view, a first embodiment of a grid according to the present invention associated with a conventional cathode.
Figure 5:
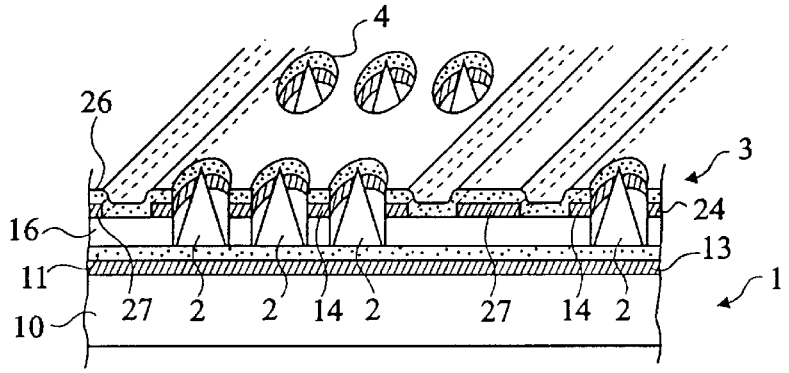
FIG. 5 partially shows, in cut perspective view, a second embodiment of a grid according to the present invention associated with a conventional cathode.
Figure 6:
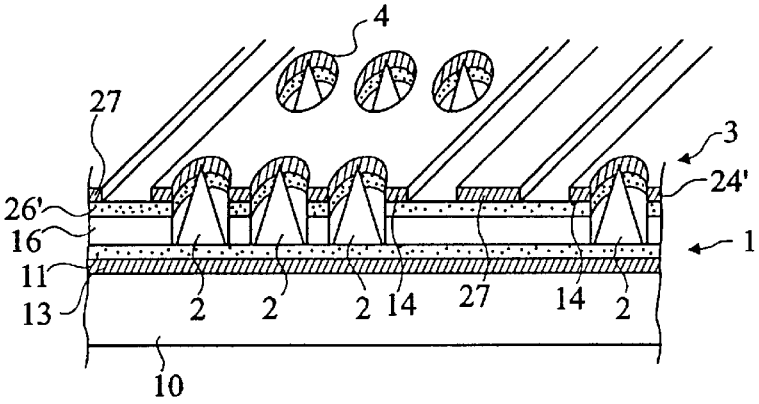
FIG. 6 partially shows, in cut perspective view, a third embodiment of a grid according to the present invention associated with a conventional cathode.

According to a first aspect of the present invention, several embodiments of which are illustrated by FIGS. 4 to 6, the scan electrodes are formed by conductive lines of the grid. The cathode then is, according to this first aspect, a conventional cathode organized in columns, the addressing of which is also performed conventionally.

According to this first aspect of the present invention, each line of the grid is connected, via at least one resistive element, to a so-called reset or return electrode, biased to a low potential corresponding to a potential at which the grid lines prevent the emission of electrons.

FIG. 4 partially shows, in top view, a first embodiment of a cathode/grid according to the first aspect of the present invention.

For clarity, a single hole 4 has been shown in each line 14 of the grid at its intersection with a column 15 of the cathode.

Each grid line is addressable, individually and sequentially, by means of a control amplifier 21. According to the present invention, each amplifier 21 is formed of a single MOS transistor, here with a P channel, connected between a high addressing potential +Vg and the corresponding line. Each transistor P is, for example, controlled by a two-state signal C, a given line being addressed when signal C is in a low state, that is, at a potential sufficiently lower than potential +Vg to turn on the corresponding P transistor. The unaddressed lines are thus left at a floating potential from the viewpoint of amplifiers 21 of control of these lines.

According to the embodiment of FIG. 4, each line 14 of the grid is connected, via a resistive section 22, to a conductor 23 biased to a low potential .Vg. Sections 22 are, for example, formed of a very thin conductor, so that the contact between each line 14 and conductor 23 is resistive.

By means of resistive contacts 22, each line 14 of the grid is, at the end of an addressing, brought back to a sufficiently low potential to prevent any electron emission by this line. The sizing of resistive sections 22 depends on the functional characteristics of the screen and, in particular, on the respective values of the addressing potentials.

Figure 2B:
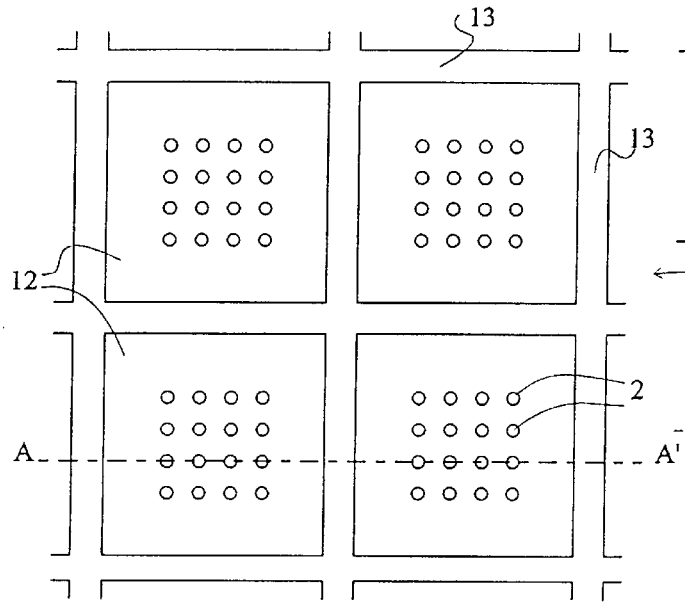
FIG. 2B illustrates an enlarged view of a portion of the structure of FIG. 2A.
Figure 2A:
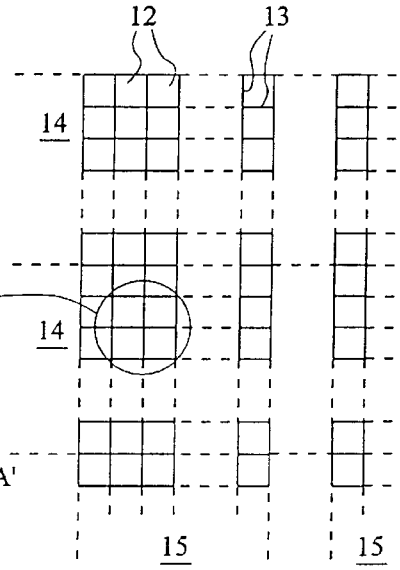
FIG. 2A illustrates a conventional microtip screen/cathode structure.
Figure 2C:
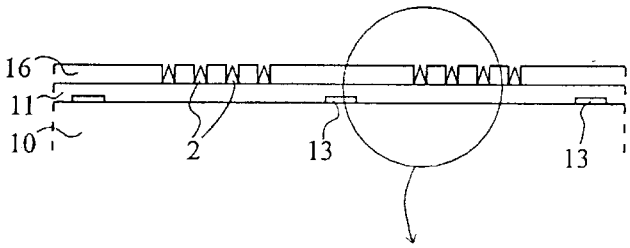
FIG. 2C illustrates another view of the conventional microtip screen/cathode structure of FIG. 2A.
Figure 2D:
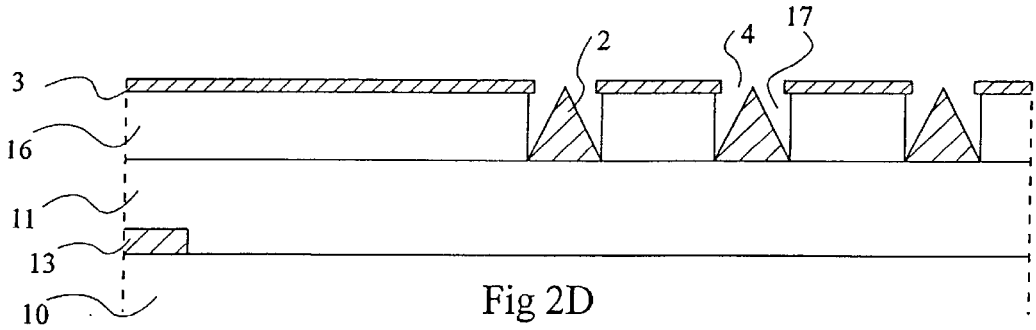
FIG. 2D illustrates an enlarged view of a portion of the structure of FIG. 2C.

Sections 22 are made, preferably, at the same time as lines 14. Sections 22 are preferably made in the same material as lines 14 and electrode 23, from a conductive layer deposited on the insulating layer (16, FIGS. 2C and 2D) separating the grid from the cathode.

The return electrode is, for example, permanently biased to potential .Vg. In this case, a dissipation appears in the resistive element connecting a line being addressed to the return electrode. To suppress this dissipation during the addressing, it could be provided to only bias the return electrode between two line times. In this case, the only dissipation which occurs while the return electrode is biased is due to the return, to the low potential, of the line electrode just addressed.

As a specific example, for a screen of approximately 13 cm (5¼ inches) in diagonal, sections 22 may be formed of conductors of a 120-mm length and a 12-$\mu$m width. With a material (for example, niobium) having a 4-Ω sheet resistance, a 40-kΩ resistance per section 22 is obtained. If potential +Vg is 80 volts, potential .Vg being the ground and potentials Vk of column addressing being included between 0 and 40 volts, the leakage current associated with section 22 is on the order of 2 mA, which results in a dissipation of approximately 160 mW. Of course, sections 22 can follow paths of different shapes (coil, zigzag, etc.) enabling to achieve the desired resistance according to the available space.

FIG. 5 illustrates, by a partial cut perspective view, a second embodiment of a cathode/grid of a microtip screen according to the first aspect of the present invention.

Cathode 1, made on substrate 10, for example, in glass, is formed of conductors 13 organized in columns from a conductive layer. A first resistive layer 11 of homogenization of the electron emission is interposed between cathode conductors 13 and the microtips 2 which are deposited on this resistive layer. The structure of the cathode shown in FIG. 5 can be similar to that illustrated by FIGS. 2A to 2C. As an alternative, the resistive layer may be deposited under the cathode conductors, microtips 2 preferably being deposited on resistive layer 11, at the center of meshes defined by the cathode conductors. Cathode 1 is separated from grid 3 by an insulating layer 16 and the grid is formed in a conductive layer 24, etched according to a pattern of lines 14 perpendicular to the cathode columns. According to the present invention, additional conductors 27 are interposed between lines 14 of the grid. Conductors 27 are interconnected to one of their ends and form the electrode of return to low potential .Vg (FIG. 4). Each line 14 of the grid is addressed by an amplifier 21 such as shown in FIG. 4.

According to the embodiment of FIG. 5, a resistive layer 26 is added on layer 24 in which are formed lines 14 and lines 27. Each line 14 of grid 3 thus is, laterally, in resistive contact with two conductors 27.

An advantage of this embodiment with respect to the embodiment illustrated in FIG. 4 is that the contact resistance between grid lines 14 and lines 27 is homogeneous all along lines 14.

FIG. 6 illustrates a third embodiment of the first aspect of the present invention which differs from the embodiment described in relation with FIG. 5 by the fact that resistive layer 26', of organization of the resistive contacts between lines 14 of grid 3 and intermediary lines 27 of the return electrode, is under conductive layer 24'.

It should be noted that, in the two embodiments illustrated by FIGS. 5 and 6, no additional masking step is necessary with respect to a conventional method of manufacturing of a cathode/grid. A step of deposition (of the second resistive layer) and a step of etching of the holes in the resistive layer (in the same etching mask as that conventionally used to etch insulating layer 16) are simply added.

An advantage of the present invention is that it simplifies the constitution of the scan line control amplifiers, without it being necessary to perform an electron emission from dedicated microtips, which improves the screen lifetime.

Another advantage of the present invention is that thin conductors 22 (FIG. 4) or intermediary lines 27 (FIGS. 5, 6) of the return electrode can be of a sufficiently low bulk to be able to be interposed between each grid line 14 without bearing prejuice to the screen resolution.

A second aspect of the present invention will be described hereafter in relation with FIGS. 7 and 8.

According to this second aspect of the present invention, the sequentially addressed scan electrodes are formed by conductive lines of the microtip cathode, and the simultaneously addressed electrodes are formed by conductive columns of the grid.

Figure 7:
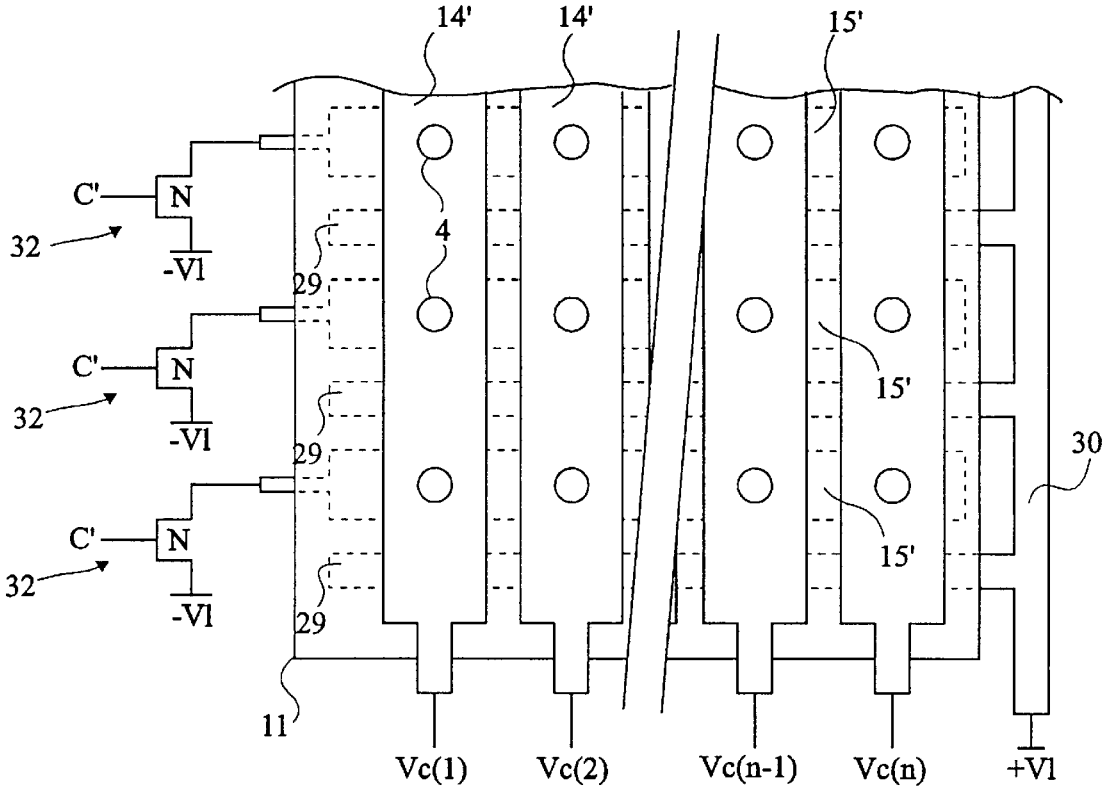
FIG. 7 shows, in top view, an embodiment of a cathode/grid according to a second aspect of the present invention.

FIG. 7 shows, partially and in top view, an embodiment of a cathode/grid according to this second aspect. FIG. 8 is a partial view, in cut perspective, of a cathode/grid according to this embodiment.

Here, the scan line return electrode is meant to be put in resistive contact with the cathode lines.

Figure 8:
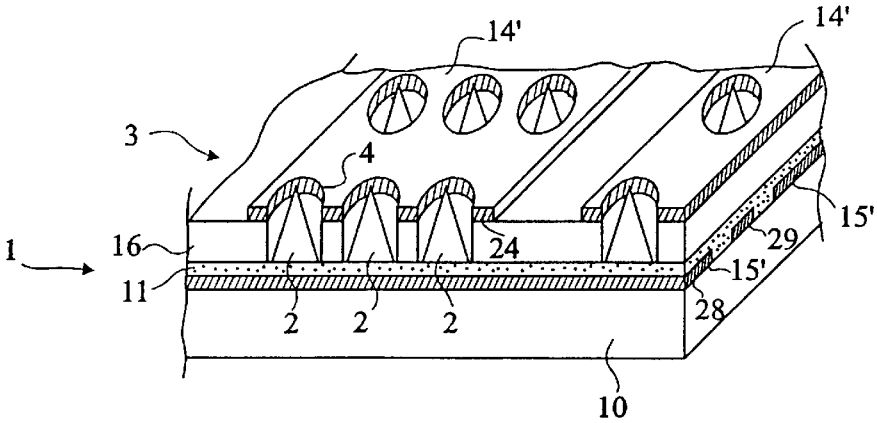
FIG. 8 shows, partially and in cut perspective view, the cathode/grid of FIG. 7.

In the embodiment shown in FIGS. 7 and 8, a conductive layer 28 is deposited full plate on substrate 10. Layer 28 is etched according to a definition pattern of cathode lines 15' and of intermediary conductors 29 of the return electrode. Although this has not been shown in FIGS. 7 and 8, cathode lines 15' are, preferably, etched according to a mesh pattern (12, FIGS. 2A, 2B). A resistive layer 11 is deposited full plate on (or under) the cathode conductors and intermediary conductors 29. Intermediary conductors 29 interposed between lines 15' are interconnected at one end of the screen and interconnection line 30 (FIG. 7) is meant to be biased to a high potential +V1 corresponding to a no electron emission potential. Each line 15' is individually addressable by means of a control amplifier 32 (FIG. 7), here essentially formed of an N-channel MOS transistor connected between the end of line 15' and a low potential .V1 of addressing of the line involved. The N transistors are sequentially controlled by two-state signals C', a line being addressed when signal C' is in a high state (at a potential higher than potential .V1) turning on the N transistor. The unaddressed lines are left floating by their respective control amplifiers 32.

As in the case where the grid forms the scan electrodes, the return electrode is biased either permanently, or temporarily at the end of each line time.

Resistive layer 11, deposited full plate on lines 15' and 29, forms a resistive link between each line 15' of the cathode and the two intermediary conductors 29 which surround it. Thus, the lines are brought back, at the end of an addressing and via resistive layer 11, to potential +V1 preventing the electron emission.

Microtips 2 are deposited on resistive layer 11 in the meshes (12, FIGS. 2A, 2B) defined by the conductors (13, FIG. 2B) of lines 15', in holes 4 etched in insulating layer 16 and in a conductive layer 24 in which the grid is made, organized in columns 14'. Columns 14' of the grid are addressable individually and simultaneously by being, each, brought to a potential corresponding to the brightness desired for the pixel defined by the intersection of the addressed cathode line 15' and of the corresponding column 14'.

As a specific example of implementation, potential .V1 is equal to 0.40 volts, potential +V1 corresponding to +40 volts. Grid columns 14' are addressed at potentials Vc ranging between 0 and +40 volts, a maximum emission corresponding to a potential Vc of +40 volts while the corresponding cathode line 15' is biased to a −40-volt potential.

An advantage of the present invention according to this second aspect, where the grid and cathode addressing is inverted with respect to a conventional screen, is that line control amplifiers 32 may be implemented by means of N-channel MOS transistors only.

Another advantage of providing such an inverted addressing is that a resistive layer (26, FIG. 5. 26', FIG. 6) is thus spared, and resistive layer 11 of electron emission homogenization is used to perform the resistive contact to the return electrode.

In the embodiment illustrated by FIGS. 7 and 8, it is no longer required to etch resistive layer 11 since the cathode conductors are sequentially, and no longer simultaneously, addressed. There is thus no longer a risk of current leakage between the cathode conductors. Further, since the grid columns are separated from one another by insulating layer 16, there is no current leakage between the simultaneously addressed columns. An advantage of the present invention according to this embodiment is that the absence of the resistive layer spares a masking and etching step of the method of manufacturing of the cathode/grid.

According to a second embodiment (not shown) implementing the second aspect (inverted addressing) of the present invention, resistive layer 11 is etched according to the pattern of cathode lines 15'. In this case, sections of this resistive layer, perpendicular to lines 15', are maintained to contact conductors 29. Such an embodiment is, for example, meant for a screen in which substrate 10 forms the screen surface. In this case, the cathode conductors and conductors 29 are, preferably, made on resistive layer 11 directly deposited on substrate 10, and the cathode conductors have a meshed structure.

According to another embodiment, not shown, implementing the second aspect of the present invention, the conductors of the return electrode are deposited on resistive layer 11, between the grid columns and parallel thereto. In this case, the insulating layer (16, FIG. 8) is etched before the deposition of the conductive grid layer which is etched, in a same step, according to the pattern of grid columns 14' on insulating layer 16 and according to the pattern of the conductors (in column) of the return electrode on resistive layer 11.

The sizings and characteristics of the materials used to implement the resistive elements between the scan lines and the conductors of the return electrode will be adapted to minimize the consumption due to the scan line resetting, and so that the time required for this resetting is lower than the line addressing time, this time being linked to the capacitance of the scan lines.

As a specific example, a screen of approximately 13 cm in diagonal in which cathode lines 15' have a length on the order of 100 mm with a 10-$\mu$m interval being left between each line 15' and the two conductors 29 which surround it may be made. Assuming that resistive layer 11 has a resistance of 300 MΩ per square, the value of the resistance between each cathode line and the return potential is on the order of 30 kΩ. Assuming that there is a voltage on the order of 80 volts between potentials .V1 and +V1, the consumption due to the return is on the order of 420 mW.

If the line capacitance of a cathode is on the order of 450 pF, the time required to bring a line just addressed to potential +V1 is on the order of 7 $\mu$s, which is perfectly compatible with a line time which generally is on the order of 40 $\mu$s for such a screen.

Of course, the present invention is likely to have various alterations, modifications, and improvements which will readily occur to those skilled in the art. In particular, it could be tried to decrease the consumption due to the return by increasing the space between the scan lines and the conductors of the return electrode, and/or by etching the resistive layer, to only leave punctual return resistors between the lines and the conductors of the return electrode.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A flat display screen, comprising a cathode and grid assembly, said cathode including electron emission microtips, and said grid being for extracting electrons from the microtips, the cathode and grid assembly comprising:

a plurality of conductive lines being sequentially addressable;

a plurality of conductive columns formed perpendicular to the lines and being individually and simultaneously addressable during the sequential addressing of one of said lines;

a return electrode biased to a return potential corresponding to a no electron emission potential for said microtips; and, a plurality of resistive elements;

wherein, each of said lines is connected via at least one of said resistive elements to the return electrode such that each line is biased substantially to said return potential after being sequentially addressed.

2. The screen of claim 1, wherein the return electrode includes conductors interposed between two neighboring ones of said lines and biased to the return potential.

3. The screen of claim 2, wherein each conductor of the return electrode forms one of said resistive elements interconnected between a neighboring one of said lines and the return potential.

4. The screen of claim 1, wherein the lines and the conductors of the return electrode are implemented in a same etched conductive layer, and each conductor of the return electrode is spaced apart from two neighboring ones of said lines.

5. The screen of claim 4, further comprising a resistive layer formed over or under the conductive layer.

6. The screen of claim 5, wherein the microtips are deposited on the resistive layer.

7. The screen of claim 6, wherein the return electrode is formed of conductors, interposed between the columns and separated from the conductive layer by the resistive layer.

8. The screen of claim 1, wherein each line is coupled to a control amplifier including an output stage which consists of a P-channel MOS transistor interposed between a high addressing potential and one of said lines, and the return electrode is biased to a low potential.

9. The screen of claim 1, wherein each of said lines is addressable by a control amplifier, an output stage of which consists of an N-channel MOS transistor interposed between a low addressing potential and addressed one of said lines, and the return electrode is biased to a high potential.

10. The screen of claim 1, wherein the return electrode is biased between the periods of addressing of two successive ones of said lines, and is left floating during line addressing.

* * * * *